US006921357B2

(12) United States Patent
Basting

(10) Patent No.: US 6,921,357 B2
(45) Date of Patent: Jul. 26, 2005

(54) TENSILE EXERCISE DEVICE

(76) Inventor: Jack Basting, 2312 D Crestview Dr., Hudson, WI (US) 54016

( * ) Notice: Subject to any disclaimer, the term of this patent is extended or adjusted under 35 U.S.C. 154(b) by 0 days.

(21) Appl. No.: 10/364,897

(22) Filed: Feb. 12, 2003

(65) Prior Publication Data

US 2004/0157710 A1 Aug. 12, 2004

(51) Int. Cl.[7] ..... A63B 21/00
(52) U.S. Cl. ..... 482/121; 482/126
(58) Field of Search ..... 482/124, 126, 482/121, 140, 131, 91, 907, 148, 122, 125, 112

(56) References Cited

U.S. PATENT DOCUMENTS

| | | | | |
|---|---|---|---|---|
| 1,633,124 | A | | 6/1927 | Noe |
| 1,638,003 | A | | 8/1927 | Neumann |
| 1,706,654 | A | | 3/1929 | Christesen |
| 1,717,861 | A | | 6/1929 | Washburn |
| 1,749,544 | A | | 3/1930 | Pagano |
| 1,866,024 | A | | 7/1932 | Gailey |
| 1,870,750 | A | | 8/1932 | Reach |
| 1,884,392 | A | | 10/1932 | Treat |
| 3,062,543 | A | | 11/1962 | Shaboo et al. |
| 3,312,466 | A | | 4/1967 | Melchiona |
| 4,040,620 | A | | 8/1977 | Friedman |
| 4,204,674 | A | | 5/1980 | Ogland |
| 4,335,875 | A | | 6/1982 | Elkin |
| 4,565,367 | A | | 1/1986 | Kaiser |
| 4,570,929 | A | | 2/1986 | Shoemaker |
| 4,648,130 | A | * | 3/1987 | Kuznetz |
| 4,690,402 | A | | 9/1987 | Basting |
| 5,086,629 | A | * | 2/1992 | Dibrell |
| 5,088,549 | A | * | 2/1992 | Schneider |
| 5,141,223 | A | * | 8/1992 | Block |

* cited by examiner

*Primary Examiner*—Jerome W. Donelly
(74) *Attorney, Agent, or Firm*—Kinney & Lange, P.A.

(57) ABSTRACT

A device for performing resistance exercises includes a non-elastic strap having a first end and a second end. The device includes a first stretchable member having a first end coupled to the non-elastic strap proximate the first end and a second stretchable member having a first end coupled to the non-elastic strap proximate the second end. The device includes a first adjusting mechanism disposed proximate the first end of the non-elastic strap and a second adjusting mechanism disposed proximate the second end of the non-elastic strap. The first and second adjusting mechanisms are manipulated to adjust the length of the non-elastic strap between the first and second stretchable members.

22 Claims, 3 Drawing Sheets

TENSILE EXERCISE DEVICE

BACKGROUND OF THE INVENTION

The present invention relates to an exercise device. More particularly, the present invention relates to a portable exercise device which employs elastic resistance to strengthen muscles.

Tensile exercising devices have been developed which can be stretched, pulled or extended by an exerciser in order to develop and maintain body muscle. Tensile exercise devices in the prior art included a series of tightly coiled springs having handles attached at opposite ends. As the handles are pulled apart, the springs are extended and provide resistance. The resistance is overcome by the person using the device which results in an increase in muscle mass within the body.

While the coiled springs are useful as tensile exercising devices, the coiled springs present several drawbacks including, but not limited to weight, size and appearance. Additionally, the extended springs have the potential of pinching the skin of the exerciser when the spring is contracted. Besides, creating the potential of pinching the skin of the exerciser, the springs are uncomfortable when pressed against the exerciser's skin.

In addition to creating a safety issue, the handles connected to the springs are typically made of a relatively rigid material. The rigid handles are needed to properly interface with the coiled springs and other mechanical elements of the device. The rigid handles become difficult to grip due to perspiration and may slip out of the exerciser's grip. If the exerciser loses the grip on the handles while the springs are extended, the springs will recoil uncontrollably and potentially injure the exerciser or bystanders or cause damage to the device or nearby property.

Other tensile exercising devices employ rubber or other elastic materials which have handles fastened at opposite ends. While devices which employ rubber or other elastic materials are generally more portable than coiled spring devices, the handles are still typically made of a rigid material in order to facilitate attachment of the handles to the rubber or elastic materials. Using a rigid material for the handle results in the same problems as discussed regarding the handles attached to the coiled springs, namely, difficulty in gripping the handles while the exerciser is perspiring.

Alternatively, the handles can be integrally formed with the rubber or elastic material. While the handle is made of a non-rigid material, facilitating better gripping, there are drawbacks to the integral handle design, namely, when the handle fails or develops a defect, the entire device must be replaced. An alternative to the integral handle is to use loops of material for gripping. However, loops of material tend to be uncomfortable to the exerciser, and do not allow the exerciser to exercise the muscles in the lower arms, hands and fingers.

Another common problem with prior art tensile exercise devices is that the resistance can not be varied. Because the resistance can not be varied, beginners would have difficulty in using the device while people who have well developed muscles would not have enough resistance to maximize the benefits of the device. Additionally, the length of the tensile exercise devices typically cannot be adjusted to accommodate different sized people. When the device does not fit the exerciser properly, the exerciser cannot efficiently utilize the device and therefore achieves less gains than if the device properly fit the exerciser.

BRIEF SUMMARY OF THE INVENTION

The present invention includes a device for performing resistance exercises. The device includes a non elastic strap having a first end and a second end. The device includes a first stretchable member having a first end coupled to the non-elastic strap proximate the first end and a second stretchable member having a first end coupled to the non-elastic strap proximate the second end. The device includes a first adjusting mechanism disposed about the non-elastic strap proximate the first end and a second ad lusting mechanism disposed about the non-elastic strap proximate the second end. The first and second adjusting mechanisms are manipulated to adjust the length of the non-elastic strap between the first ends of the first and second stretchable members.

DETAILED DESCRIPTION

Figure 1:
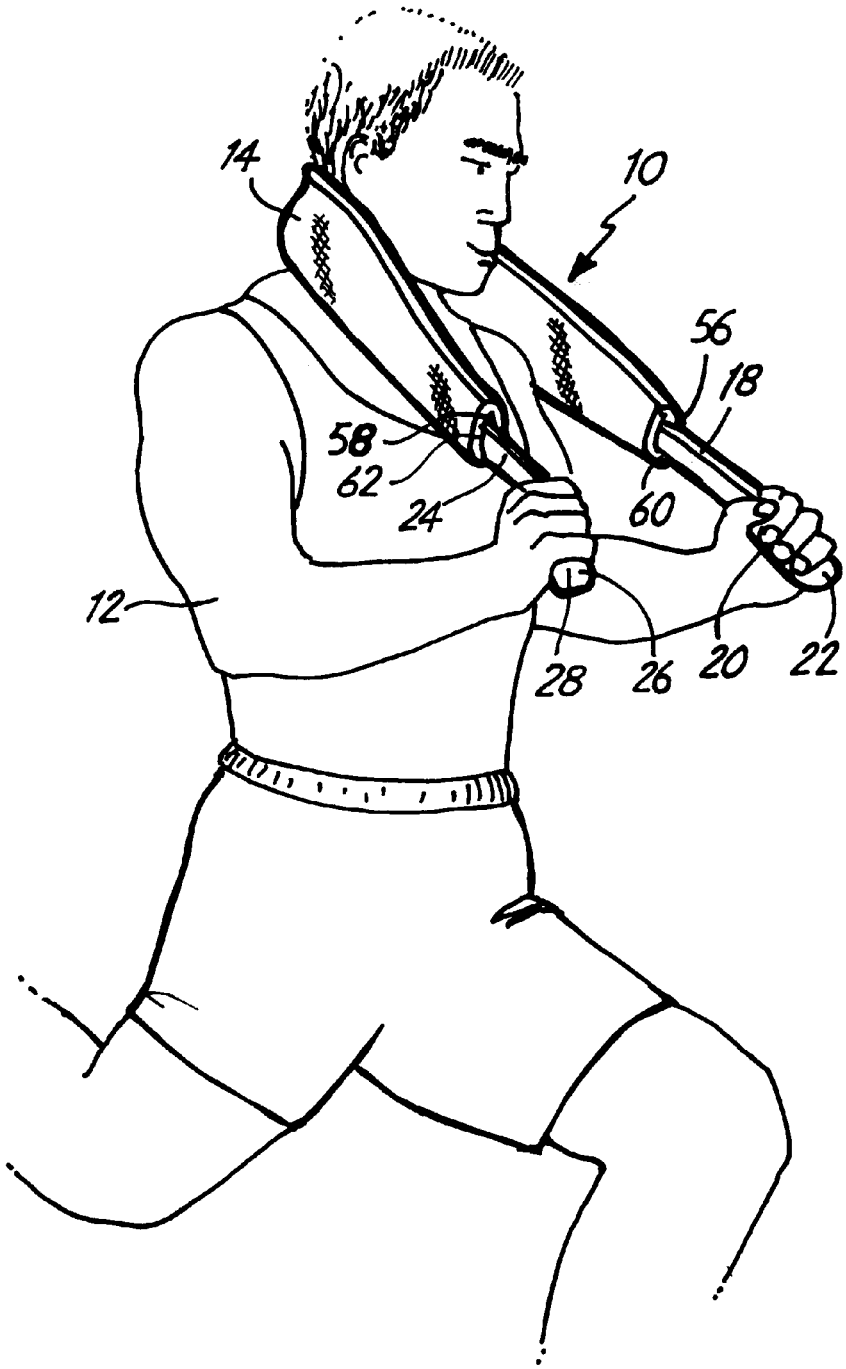
FIG. 1 is a perspective view of the present invention in use.

The tensile exercise device of the present invention is generally illustrated in FIG. 1 at 10. The tensile exercise device 10 includes first and second stretching members 18, 24 disposed and extending through first and second apertures 56, 58 at distal ends 60, 62, respectively, of a sheath 14.

Figure 2:
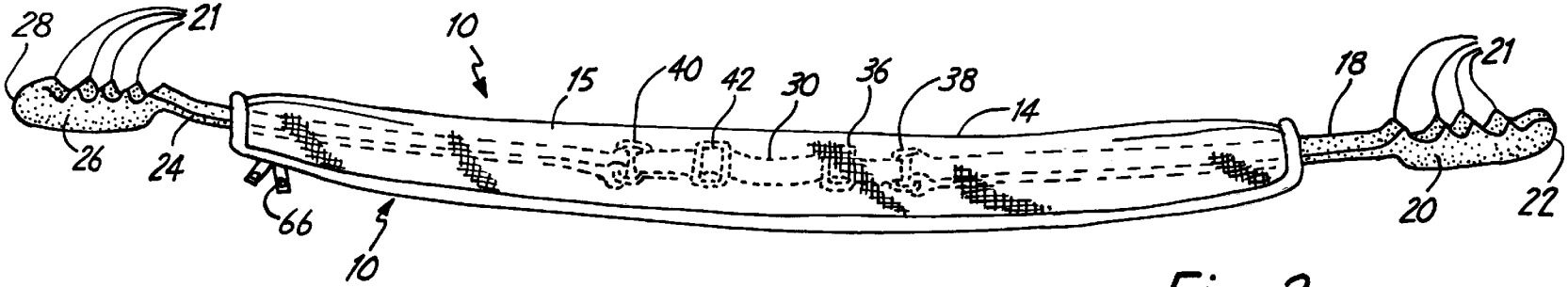
FIG. 2 is a perspective view of the present invention.
Figure 3:
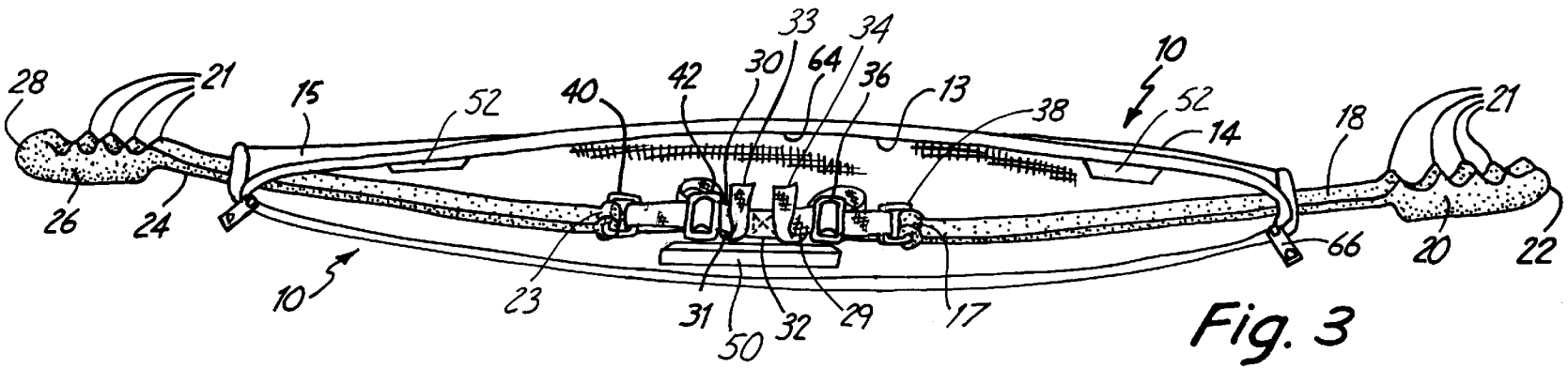
FIG. 3 is a perspective view of the present invention with the sheath having a longitudinal opening in an open position.

Referring to FIGS. 2 and 3, the sheath 14 preferably is constructed of a water-resistant material on the inner surface 13 covered with a water-absorbent outer surface 15 to absorb perspiration. The sheath includes a longitudinal opening 64 which includes a closure mechanism 66 where the closure mechanism is preferably a zipper.

Referring to FIG. 1, an exerciser 12 disposes the sheath 14 about the exerciser's neck and grasps handles 20, 26 proximate second ends 22, 28 of the first and second stretching members 18, 24, respectively. The handles 20, 26 each have a plurality of ridges 21, as best illustrated in FIGS. 2–5, which conform to the exerciser's hands to facilitate better gripping. While gripping the handles 20, 26, the exerciser 12 extends his/her arms to stretch the first and second stretching members 18, 24 to exercise various arm muscles including the bicep and tricep. The device 10 is also capable of being used to exercise other areas of the body including the neck, shoulders and legs.

Referring to FIGS. 2 and 3, the tensile exercising device 10 includes a generally non-elastic strap 30 connecting the first and second stretching members 18, 24, respectively. The generally non-elastic strap 30 is fixedly attached, preferably by stitching 32, to the inner surface 13 of the sheath 14 approximately at the midpoint of the generally non-elastic strap 30. The stitching 32 divides the generally non-elastic strap 30 into a first segment 29 and a second segment 31.

A first end 34 of the first segment 29 is disposed through a first ring 38 rotatably secured to a first end 17 of the first stretching member 18. The first ring 38 is preferably constructed of a metal material and preferably has a generally rectangular configuration. After the first end 34 is disposed through the first ring 38, the first end 34 is disposed through a first buckle 36. A length of the first segment 29 between the stitching 32 and the first ring 38 is manipulated by adjusting the distance of the first end 34 in relationship to the first buckle 36. The first buckle 36 is preferably retained in a selected position by a loop of material (not shown) which is retained in position by the stitching 32. The first buckle 36 retains the first segment 29 at a first selected length, preferably by a first frictional engagement. Although a frictional engagement is preferred other engagement mechanisms including a buckle having a member engage a hole in the generally inelastic strap 30 or a series of snaps or fasteners are within the scope of the invention.

A second end 33 of the second segment 31 is disposed through a second ring 40 rotatably secured to a first end 23 of the second stretching member 24. The second ring 40 is preferably constructed of a metal material and preferably has a generally rectangular configuration. After the second end 33 is disposed through the second ring 40, the second end 33 is further disposed through a second buckle 42. A length of the second segment 31 between the stitching 32 and the second ring 40 is manipulated by adjusting a distance of the second end 33 in relationship to the second buckle 42. The second buckle 42 is preferably retained in a selected position by a loop of material (not shown) which is retained in position by the stitching 32. The second buckle 42 retains the second segment 31 at a second selected length by a frictional engagement. Although a frictional engagement is preferred, other securing mechanisms are within the scope of the invention including a buckle having a member engaging a hole in the strap, and a series of snaps or fasteners.

The adjustability of the first and second segments 29, 31, respectively, of the generally non-elastic strap 30 allows the distance between the handles 20, 26 of the first and second stretching members 18, 24, respectively, to be adjusted to fit the exerciser's body. The ability to adjust the distance between the first and second handles 20, 26 allows the exerciser to customize the length of the device 10 to the exerciser's body. With the device 10 conforming to the exerciser's body, the exerciser is able to comfortably grip the handles 20, 26 and efficiently use the resistance of the stretching members 18, 24 to exercise his/her muscles.

Because the first and second stretching members 18, 24, respectively, are fixedly attached to the first and second rings 38, 40, respectively, the first and second stretching members 18, 24 can be conditioned and lubricated to extend the life of the stretching members 18, 24. Devices where the length of the stretching members 18, 24 are manipulated to adjust the distance between the handles 20, 26 cannot employ a lubricant or conditioner because the lubricant or conditioner allow the stretching members 18, 24 to slip when a force was applied. One skilled in the art will recognize that stretchable members 18, 24 of differing resistances are within the scope of the invention to accommodate exercisers of varying fitness and strength levels.

Figure 4:
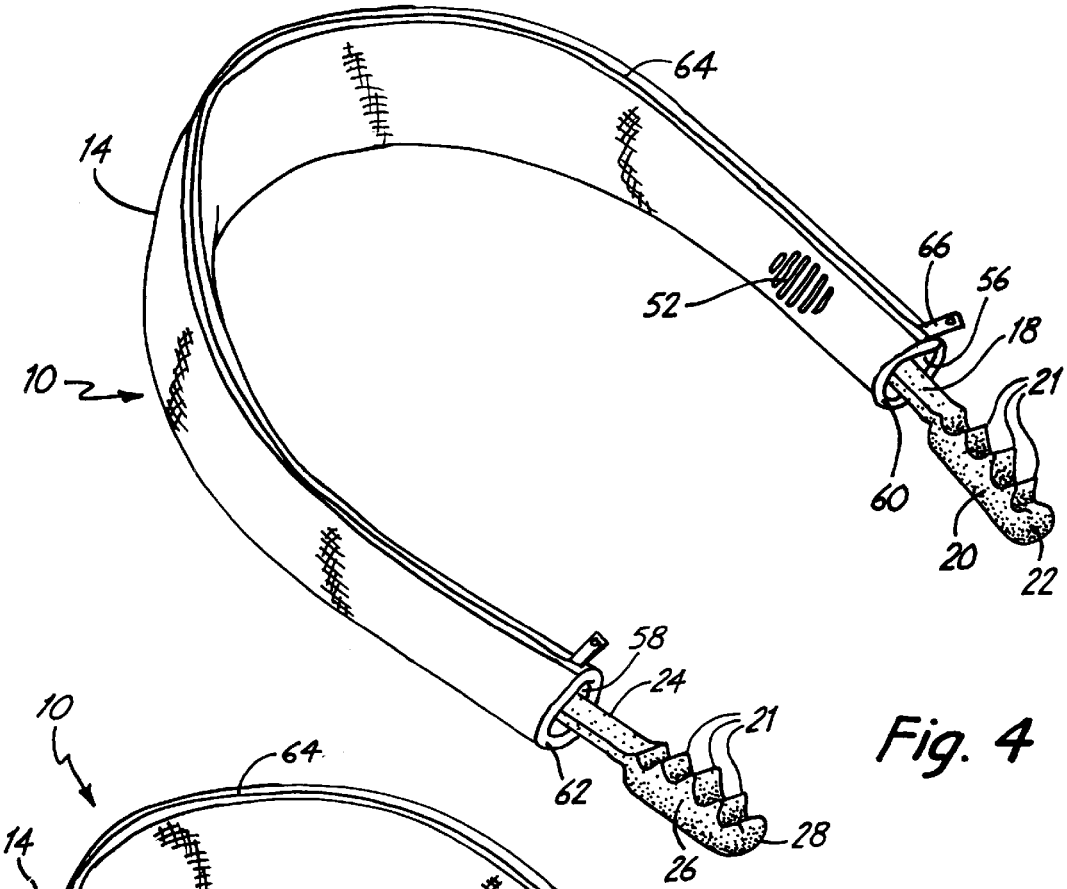
FIG. 4 is a perspective view of the present invention including a radio and a speaker.
Figure 5:
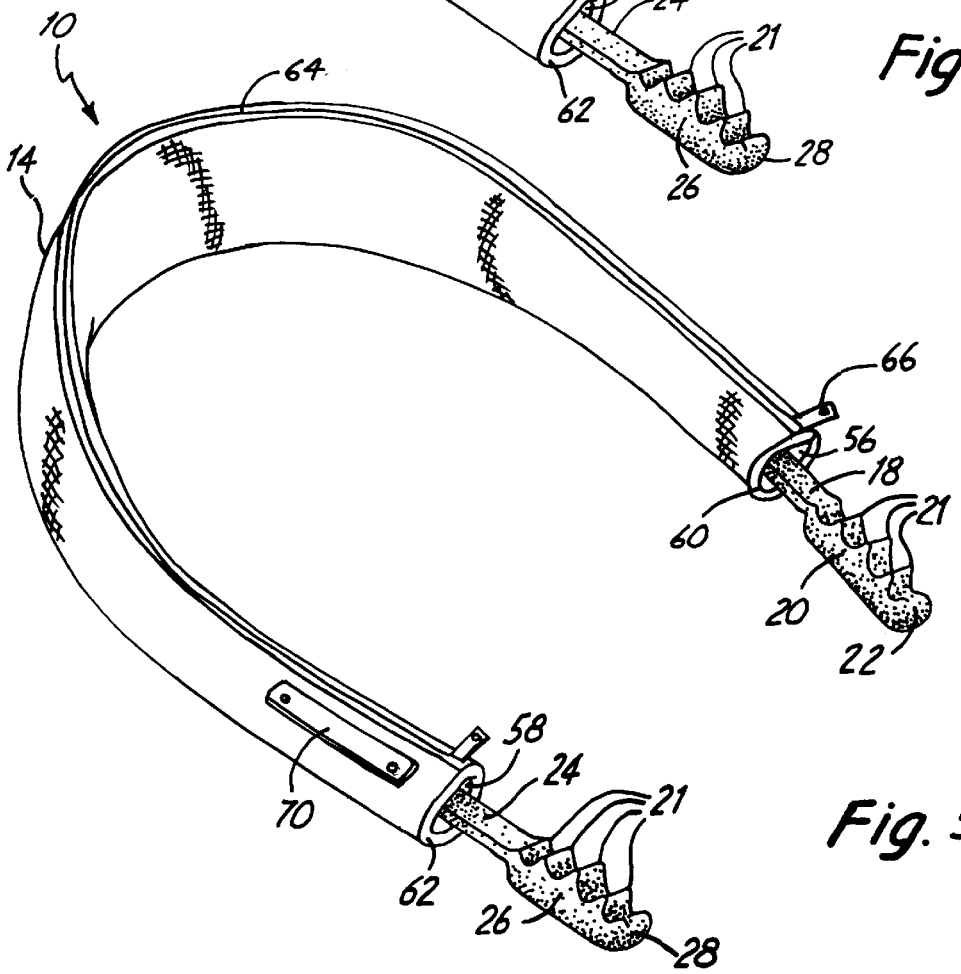
FIG. 5 is a perspective view of the present invention including a pocket.

Referring to FIG. 4, it is also within the scope of the invention to dispose a radio 50 with a speaker 52 within the sheath 14. The radio 50 and speaker 52 allow an exerciser to listen to a desired radio station while exercising. One skilled in the art will recognize that the radio 50 and speaker 52 should be light weight so as to not hinder the balance and movement of the device. Referring to FIG. 5, it is also within the scope of the invention to have a pocket 70 within the interior of the sheath 14 or attached to the outer surface 15 to allow the exerciser to securely store keys, money and other items while exercising.

Although the present invention has been described with reference to preferred embodiments, workers skilled in the art will recognize that changes may be made in form and detail without departing from the spirit and scope of the invention.

What is claimed is:

1. A device for performing resistance exercises comprising:

a non-elastic strap having a first end and a second end;

a first stretchable member having a first end and a second end wherein the first end of the first stretchable member couples with the non-elastic strap proximate the first end thereof;

a second stretchable member having a first end and a second end wherein the first end of the second stretchable member couples with the non-elastic strap proximate the second end thereof;

a first adjusting mechanism disposed proximate the first end of the non-elastic strap; and a second adjusting mechanism disposed proximate the second end of the non-elastic strap wherein the first and second adjusting mechanisms are manipulated to adjust the length of the non-elastic strap between the first and second stretchable members such that an exerciser can grip the second ends of the first and second stretchable members.

2. The device of claim 1 and further comprising:

a first ring coupling the first stretchable member to the non-elastic strap; and a second ring coupling the second stretchable member to the non-elastic strap.

3. The device of claim 1 and further comprising:

a first grip member attached to the second end of the first stretchable member; and a second grip member attached to the second end of the second stretchable member.

4. The device of claim 1 wherein the first adjusting mechanism comprises a first buckle wherein the first end of the non-elastic strap is adjustably disposed therethrough and wherein the first buckle retains the non-elastic strap at a first selected length by a first frictional engagement.

5. The device of claim 1 wherein the second adjusting mechanism comprises a second buckle wherein the second end of the non-elastic strip is adjustably disposed therethrough and wherein the second buckle retains the non-elastic strap at a second selected length by a second frictional engagement.

6. The device of claim 1 and further comprising a sheath disposed about the non-elastic member and the first and second stretchable members wherein the second ends of the first and second stretchable members extend through apertures within the sheath.

7. The device of claim 1 wherein the non-elastic strip is fixedly attached to the sheath.

8. The device of claim 6 wherein the sheath comprises a water absorbent material.

9. The device of claim 6 wherein the sheath further comprises:

a longitudinal opening; and a zipper for opening and closing the longitudinal opening wherein the longitudinal opening provides access to the first and second adjusting mechanisms.

10. The device of claim 6 and further comprising:

a radio disposed within the sheath; and at least one speaker connected to the radio and disposed within the sheath.

11. The device of claim 6 and further comprising a pocket disposed in the sheath.

12. A tensile exercise device comprising:

a generally inelastic central portion having a first end and a second end;

a first stretching member having a first end and a second end wherein the first end operably attaches to the generally inelastic central portion proximate the first end thereof;

a second stretching member having a first end and a second end wherein the first end operably attaches to the generally inelastic central portion proximate the second end thereof;

a first length adjusting device operably engaging the generally inelastic central portion proximate the first end thereof; and a second length adjusting device operably engaging the generally inelastic central portion proximate the second end thereof wherein the first and second ends of the generally inelastic central portion are manipulated through the first and second length adjusting devices such that a selected length of the generally inelastic central portion separates the first ends of the first and second stretching members.

13. The device of claim 12 and further comprising:

a first ring operably attaching the first end of the first stretching member to the generally inelastic portion proximate a first end thereof; and a second ring operably attaching the first end of the second stretching member to the generally inelastic portion proximate a second end thereof.

14. The device of claim 12 and further comprising:

a first grip member attached to the second end of the first stretching member; and a second grip member attached to the second end of the second stretching member.

15. The device of claim 12 wherein the first length adjusting device comprises a first buckle wherein the first end of the generally inelastic central portion is disposed therethrough and wherein the first buckle retains the generally inelastic central portion at a first selected length by a first frictional engagement.

16. The device of claim 12 wherein the second length adjusting device comprises a second buckle wherein the second end of the generally inelastic central portion is disposed therethrough and wherein the second buckle retains the generally inelastic central portion at a second selected length by a second fictional engagement.

17. The device of claim 12 and further comprising a sheath disposed about the generally inelastic central portion and the first and second stretching members wherein the second ends of the first and second stretching members extend are disposed through first and second apertures within the sheath.

18. The device of claim 17 wherein the generally inelastic central portion is fixedly attached to the sheath.

19. The device of claim 17 wherein the sheath comprises a water absorbent material.

20. The device of claim 17 wherein the sheath further comprises:

a longitudinal opening; and a zipper for opening and closing the longitudinal opening wherein the longitudinal opening provides access to the first and second length adjusting mechanisms.

21. The device of claim 17 and further comprising:

a radio disposed within the sheath; and at least one speaker connected to the radio and disposed within the sheath.

22. The device of claim 17 and further comprising a pocket disposed in the sheath.

* * * * *